US010598175B2

(12) United States Patent
Kang et al.

(10) Patent No.: US 10,598,175 B2
(45) Date of Patent: Mar. 24, 2020

(54) LINEAR COMPRESSOR, AND APPARATUS AND METHOD FOR CONTROLLING A LINEAR COMPRESSOR

(71) Applicant: LG ELECTRONICS INC., Seoul (KR)

(72) Inventors: Kyoungseok Kang, Seoul (KR); Jaeyoo Yoo, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 375 days.

(21) Appl. No.: 14/831,923

(22) Filed: Aug. 21, 2015

(65) Prior Publication Data

US 2016/0053754 A1 Feb. 25, 2016

(30) Foreign Application Priority Data

Aug. 25, 2014 (KR) ..... 10-2014-0111012

(51) Int. Cl.
*F04B 49/06* (2006.01)
*F04B 39/12* (2006.01)
(Continued)

(52) U.S. Cl.
CPC ..... *F04B 49/06* (2013.01); *F04B 35/045* (2013.01); *F04B 39/0027* (2013.01);
(Continued)

(58) Field of Classification Search
CPC .. F04B 35/045; F04B 39/0027; F04B 39/122; F04B 49/005; F04B 49/06; F04B 49/065;
(Continued)

(56) References Cited

U.S. PATENT DOCUMENTS 5,125,241 A * 6/1992 Nakanishi ..... F25D 23/006 381/71.11
5,980,211 A 11/1999 Tojo et al.
(Continued)

FOREIGN PATENT DOCUMENTS

CN 1168965 12/1997
CN 1657778 8/2005
(Continued)

OTHER PUBLICATIONS

Interoational Search Report dated Nov. 9, 2015.
Chinese Office Action dated Feb. 11, 2018 (English Translation).
European Search Report dated Mar. 27, 2018.

*Primary Examiner* — Bryan M Lettman
*Assistant Examiner* — Charles W Nichols
(74) *Attorney, Agent, or Firm* — Ked & Associates LLP

(57) ABSTRACT

An apparatus and a method for controlling a linear compressor, and a linear compressor operable with high power and low noise are provided. The apparatus may include a reference operating frequency determiner that determines a reference operating frequency at which a linear motor is operated, and an actual operating frequency determiner that determines an actual operating frequency as an arbitrary value included in a predetermined numerical value range in a vertical direction around the reference operating frequency. A correction signal may be determined by the actual operating frequency.

18 Claims, 8 Drawing Sheets

(51) Int. Cl.
*F04B 35/04* (2006.01)
*F04B 39/00* (2006.01)

(52) U.S. Cl.
CPC ..... *F04B 39/122* (2013.01); *F04B 49/065* (2013.01); *F04B 2203/0401* (2013.01); *F04B 2203/0402* (2013.01); *F04B 2203/0404* (2013.01)

(58) Field of Classification Search
CPC ..... F04B 49/20; F04B 2203/0401; F04B 2203/0402; F04B 2203/0404
See application file for complete search history.

(56) References Cited

U.S. PATENT DOCUMENTS

| | | | | |
|---|---|---|---|---|
| 6,357,235 | B1 * | 3/2002 | Cerro | F01K 19/02 60/645 |
| 7,413,413 | B2 * | 8/2008 | Schnetzka | F04C 29/06 417/410.1 |
| 7,665,972 | B2 * | 2/2010 | Yoo | F04B 49/065 318/607 |
| 2003/0026702 | A1 * | 2/2003 | Yoo | F04B 35/045 417/44.11 |
| 2003/0175125 | A1 | 9/2003 | Kwon et al. | |
| 2004/0239266 | A1 | 12/2004 | Lee et al. | |
| 2005/0158178 | A1 | 7/2005 | Yoo et al. | |
| 2007/0159128 | A1 | 7/2007 | Dainez et al. | |
| 2011/0185753 | A1 * | 8/2011 | Lifson | F25B 31/006 62/115 |

FOREIGN PATENT DOCUMENTS

| | | |
|---|---|---|
| CN | 101010515 | 8/2007 |
| CN | 101094990 | 12/2007 |
| KR | 10-2002-0057548 | 7/2002 |
| KR | 10-0373098 | 2/2003 |
| KR | 10-0588717 | 6/2006 |
| KR | 10-2010-0096536 | 9/2010 |

* cited by examiner

LINEAR COMPRESSOR, AND APPARATUS AND METHOD FOR CONTROLLING A LINEAR COMPRESSOR

CROSS-REFERENCE TO RELATED

This application claims priority under 35 U.S.C. § 119 to Korean Application No. 10-2014-0111012, filed in Korea on Aug. 25, 2014, whose entire disclosure is hereby incorporated by reference.

BACKGROUND

1. Field

A linear compressor, and an apparatus and method for controlling a linear compressor are disclosed herein.

2. Background

Linear compressors are machines that suction, compress, and discharge a refrigerant using a linear drive force of a motor. Linear compressors may be roughly divided into a compression unit or device having a cylinder, and a piston, and a drive unit or device having a linear motor that provides a drive force to the compression device. The linear compressors may have advantages in that they have less friction due to their linear operation and a high energy use efficiency as most of the drive force is used for compression of gas.

In the linear compressor, a cylinder may be provided inside of a sealed container, and a piston may be provided inside of the cylinder to be movable in a linear and reciprocating manner. The piston may linearly reciprocate inside of the cylinder, and thereby a refrigerant may be allowed to flow into a compression space inside the cylinder, be compressed, and then discharged. In the compression space, a suction valve assembly and a discharge valve assembly may be provided to control inflow and outflow of the refrigerant according to a pressure within the compression space.

A linear motor that generates a linear motion force may be connected to the piston. In the linear motor, an inner stator and an outer stator, which may be configured in such a manner that a plurality of laminations are stacked in a circumferential direction around the cylinder, may be provided with a predetermined gap therebetween, coils may be wound around the inner stator and/or the outer stator, and a permanent magnet may be provided to be connected to the piston in the gap between the inner stator and the outer stator. The permanent magnet may be provided to be movable in a moving direction of the piston, and may be linearly reciprocate in the moving direction of the piston by an electromagnetic force generated according to a current flow in the coil.

The linear motor may be operated at a predetermined operating frequency (fc) so as to allow the piston to linearly reciprocate at a predetermined stroke (S). A spring may be provided so that the piston may be elastically supported in the moving direction of the piston even when the piston is linearly reciprocated by the linear motor. For example, a coil spring, which is a type of mechanical spring, may be mounted to be elastically provided in the sealed container and the cylinder in the moving direction of the piston. In addition, refrigerant suctioned into the compression space may also serve as a gas spring. The coil spring may have a predetermined mechanical spring constant (Km), and the gas spring may have a gas spring constant (Kg) that varies according to load. Thus, a natural frequency (fn) of the piston (or the linear compressor) may be calculated in consideration of the mechanical spring constant (Km) and the gas spring constant (Kg). The natural frequency (fn) of the piston may be represented by the following Equation 1.

$$f_n = \frac{1}{2\pi}\sqrt{\frac{K_m + K_g}{M}} \quad \text{[Equation 1]}$$

Where, fn denotes the natural frequency of the piston, Km denotes the mechanical spring constant, Kg denotes the gas spring constant, and M denotes a mass of the piston.

The natural frequency (fn) of the piston calculated in this manner may serve as a main factor in determining the operating frequency (of the linear motor. More specifically, by enabling the operating frequency (fc) of the linear motor to coincide with the natural frequency (fn) of the piston, that is, by operating the linear motor in a resonant state in which both frequencies coincide with each other, it is possible to maximize an operating efficiency of the linear motor. High energy use efficiency of the linear compressor may be obtained in the resonant state in which the natural frequency (fn) of the piston and the operating frequency (fc) of the linear motor coincide with each other, and the energy use efficiency of the linear compressor may be further degraded different from the resonant state.

When the linear compressor is operated, as the actual load varies, the gas spring constant (Kg) of the gas spring and the natural frequency (fn) of the piston calculated based on the gas spring constant (Kg) may change or vary. For example, as the load of the linear compressor is increased, the natural frequency (fn) of the piston may be higher. More specifically, pressure and temperature of the refrigerant in a limited space may be increased along with an increase in the load, and thereby the elastic force of the gas spring itself may be increased, causing an increase in the gas spring constant (Kg). Thereby, the natural frequency (fn) of the piston calculated in proportion to the increased gas spring constant (Kg) becomes high.

As described above, the operating efficiency and energy use efficiency of the linear compressor may be improved by enabling the operating frequency (fc) of the linear motor to coincide with the natural frequency (fn) of the piston as much as possible. However, in the linear compressor, there are mechanism natural frequencies (fc) of the piston, the cylinder, and the spring, for example. Thus, when the operating frequency (fc) of the linear motor coincides with the mechanism natural frequencies (fm), there may be a case in which the individual components cause mechanical resonance phenomena which causes loud noise and damage to products.

Due to the mechanical resonance phenomena, there is no freedom to vary the operating frequency (fc) of the linear motor. For example, when the operating frequency (fc) of the linear motor varies, the operating frequency (fc) should avoid the natural frequency (fn) of the piston, or operating frequencies that can be set as the operating frequency (fc) of the linear motor are limited to several cases.

As a variety of harmonic frequencies are also included in the mechanism natural frequencies (fm), it is more difficult to control the operating frequency (fc) of the linear motor, and a variety of problems are caused. Further, when variation in a compression capacity occurs by variable operation of a product, such as a refrigerator, or an air conditioner, for example, in which the linear compressor is provided, or in a case of responding to a variation in a compression capacity so as to implement a variety of operational aspects of the product, it is more difficult to avoid the mechanical resonance phenomena.

BRIEF DESCRIPTION OF THE DRAWINGS

Embodiments will be described in detail with reference to the following drawings in which like reference numerals refer to like elements, and wherein:

FIG. 4 illustrates a case in which a reference operating frequency is applied, and FIG. 5 illustrates a case in which an actual operating frequency is applied;

DETAILED DESCRIPTION

Hereinafter, embodiments will be described in detail with reference to the accompanying drawings. The embodiments may, however, be embodied in many different forms and should not be construed as being limited to the embodiments set forth herein; rather, alternate embodiments falling within the spirit and scope will fully convey the concept to those skilled in the art.

Figure 1:
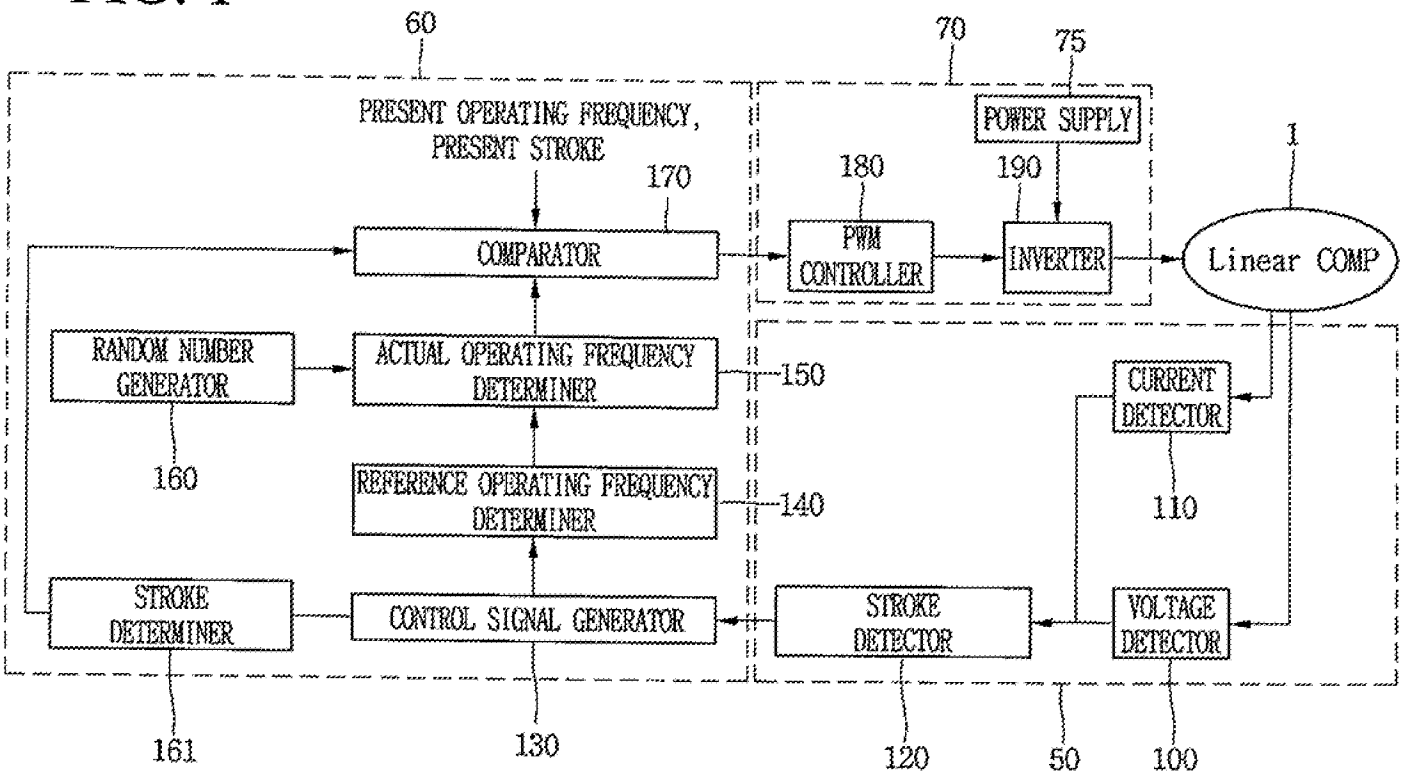
FIG. 1 is block diagram of an apparatus for controlling a linear compressor according to an embodiment.

FIG. 1 is block diagram of an apparatus for controlling a linear compressor according to an embodiment. Referring to FIG. 1, a linear compressor 1 having a compression unit or device including a drive unit or drive, a cylinder, and a piston, for example, may be provided. The apparatus for controlling the linear compressor 1 may include a detection unit or detector 50 that detects an operating state of the linear compressor 1, a control unit or controller 60 that determines an operating state of an operating frequency (fc) of a linear motor based on the operating state of the linear compressor 1 detected by the detector 50 and generates a correction signal, and a drive signal generation unit or generator 70 that generates a drive signal of the linear compressor 1 in accordance with the correction signal generated by the controller 60 and transmits the generated drive signal to the linear compressor 1.

Operations of the apparatus for controlling the linear compressor will be described hereinafter.

The detector 50 may detect an existing or current operating state of the linear compressor 1. The current operating state detected by the detector 50 may be transmitted to the controller 60, and the controller 60 may determine whether the linear motor is operated with an optimal efficiency. For example, the controller 60 may determine whether the linear motor is operated in a state in which a natural frequency (fn) of the piston and the operating frequency (fc) of the linear motor coincide with each other. The linear motor may include a stator, and a coil, for example, and may provide a drive force. The controller 60 may generate a correction signal so that the linear motor is operated with the optimal efficiency. For example, the controller 60 may generate the correction signal so that the linear compressor 1 is operated in close proximity to a resonance point in which the operating frequency (fc) of the linear motor and the natural frequency (fn) of the piston coincide with each other. The drive signal generator 70 may receive the correction signal, and output a drive signal to the linear compressor/through a predetermined motor control method.

The detector 50, the controller 60, and the drive signal generator 70, and operations thereof will be described hereinafter.

The detector 50 may include a current detector 110, a voltage detector 100, and a stroke detector 120 that detects a stroke using a detected current and voltage.

The controller 60 may determine a reference operating frequency (fc) of the linear motor so that the operating frequency (fc) of the linear motor may be optimized. For example, the controller 60 may determine the reference operating frequency of the linear motor in a direction in which the operating frequency (fc) of the linear motor and the natural frequency (fn) of the piston coincide with each other. The reference operating frequency of the linear motor may be referred to as a first operating frequency (f1). An actual operating frequency of the linear motor at which the linear motor is actually operated at a present time may be determined based on the first operating frequency (f1). The actual operating frequency of the linear motor may be referred to as a second operating frequency (f2). The first operating frequency (f1) and the second operating frequency (f2) may have a relationship of the following Equation 2.

$$f2=f1+a \qquad \text{[Equation 2]}$$

Where, 'a' denotes a linear compressor which may be changed depending on a type and specification of an apparatus in which the linear compressor is installed, and may be, for example, an arbitrary value larger than −0.3 Hz but smaller than 0.3 Hz. It should be noted that 'a' may be changed depending on various cases. However, the value of 'a' may be provided as any value when an arbitrary value included within a given value range may be provided with equal probability. The value of 'a' is a value for which a positive value and a negative value have a same absolute value, and for example, the value of 'a' may be given in a range of a minimum value of −0.3 Hz to a maximum value of +0.3 Hz. As the actual operating frequency may be controlled based on Equation 2, the actual operating frequency may be operated to be equal to the reference operating frequency through an average value of a predetermined time.

Figure 6:
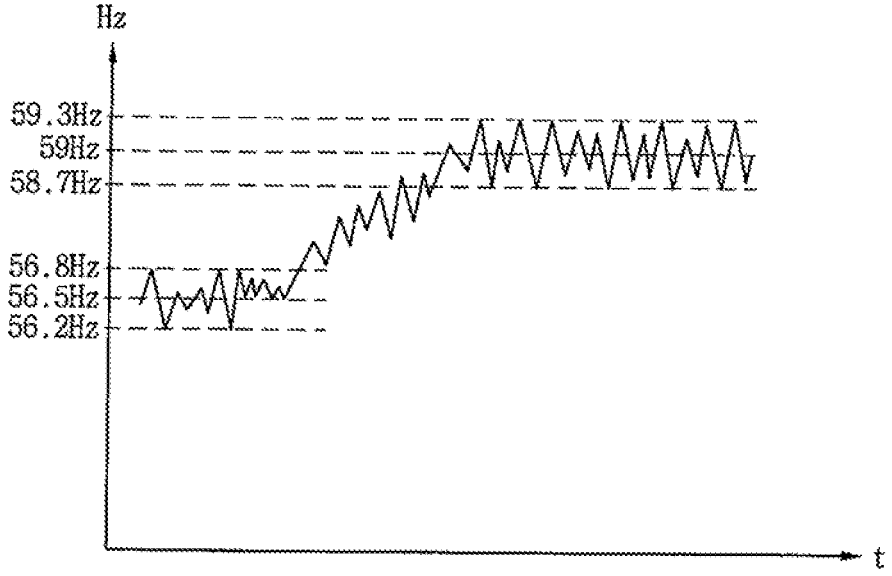
FIG. 6 is a graph illustrating variation of an operating frequency (fc) of a linear motor in a range of 56.5 Hz to 59 Hz according to an embodiment.

When analyzing Equation 2 physically, the actual operating frequency of the linear motor may be considered as being given an arbitrary value included within a range with a predetermined width around the reference operating frequency of the linear motor (see FIG. 6). In other words, when determining the operating frequency of the linear motor in a direction in close proximity to a resonance point at which the operating frequency (fc) of the linear motor and the natural frequency (fn) of the piston coincide with each other, analysis of the linear compressor 1 may proceed using the following process. For example, first, the reference operating frequency of the linear motor, which is the first operating frequency (f1), may be determined. Second, the actual operating frequency of the linear motor, which is the second operating frequency (f2), may be determined as an arbitrary value included within a range with a predetermined width around the reference operating frequency. Third, the correction signal may be generated so that the actual linear motor is operated at the actual operating frequency.

The reason why the above process is performed is to prevent a mechanical resonance phenomenon from occurring for a long period of time because the first operating frequency (f1), which is the reference operating frequency, is matched with the mechanism natural frequency (fm). Thus, in Equation 2, the value of 'a' may be changed at a predetermined time interval. For example, when the reference operating frequency is the same value for about 5 seconds, the actual operating frequency may be changed at increments of about 0.1 seconds.

In order to obtain the value of 'a', the controller 60 may include a random number generator 160. A value generated by the random number generator 160 may be transmitted to an actual operating frequency determiner 150, processed together with the reference operating frequency, and used as a factor to allow the actual operating frequency to be randomly determined within a predetermined range.

The drive signal generator 70 may receive the correction signal, generate a control signal in accordance with, for example, a PWM control method, and transmit the drive signal to the linear compressor 1. The method for controlling the linear motor according to embodiments is not limited to the PWM method, and other methods may be applicable.

A configuration and operation of an apparatus for controlling a linear compressor according to embodiments will be described in detail hereinafter.

The detector 50 may include the current detector 110, the voltage detector 100, and the stroke detector 120. The controller 60 may include a control signal generator 130, a stroke determiner 161, a reference operating frequency determiner 140, the actual operating frequency determiner 150, the random number generator 160, and a comparator 170. The drive signal generator 70 may include a PWM controller 180 and an inverter 190.

The current detector 110 may detect a current of the linear motor operated in the linear compressor 1, and the voltage detector 100 may detect a voltage of the linear motor operated in the linear compressor 1. The stroke detector 120 may detect a stroke using the detected current and voltage.

The control signal generator 130 may determine an existing or current load of the linear motor in accordance with a phase difference between the detected current and the stroke, and output a frequency control signal and a stroke control signal based on the determination result. For example, the control signal generator 130 may determine that the current load of the linear motor is a high load when the phase difference between the detected current and the stroke is smaller than a target phase difference (in this instance, the natural frequency (fn) of the piston may more be significantly changed), and output a stroke control signal for changing an existing or current stroke into a larger stroke while outputting a frequency control signal for varying the operating frequency of the linear motor to an operating frequency larger than the current operating frequency. In an opposite case, control signals may be output in an opposite manner.

Figure 3:
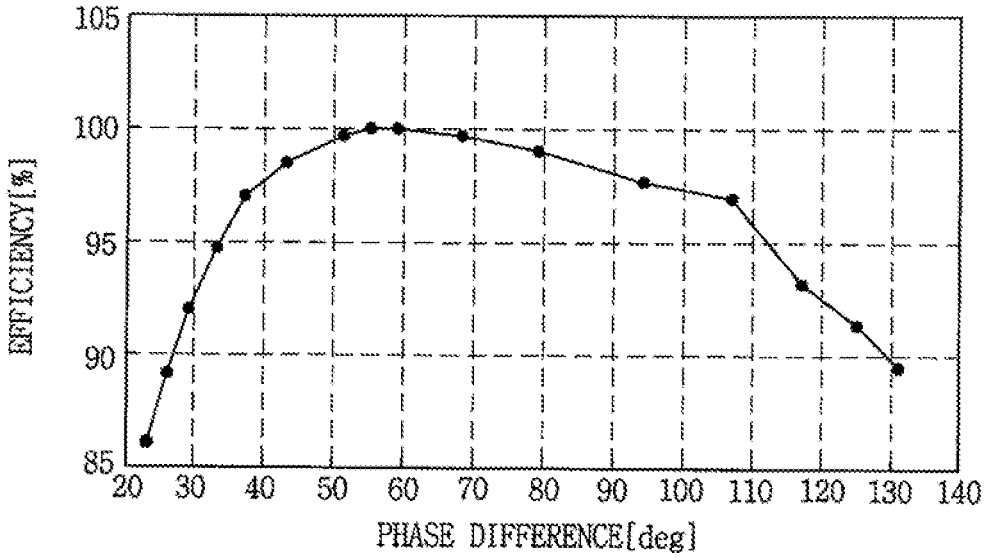
FIG. 3 is an efficiency graph of a linear motor according to a phase difference between a detected current and a stroke.

The phase difference between the detected current and the detected stroke may be understood more accurately with reference to an efficiency graph of the linear motor according to the phase difference between the detected current and the detected stroke shown in FIG. 3. Referring to FIG. 3, in a case of a linear motor used in a corresponding test, when a target phase difference is approximately 60 degrees, it may be seen that an operating efficiency of the linear motor reaches 100%, In this manner, by comparing the target phase difference and the phase difference between the detected current and the detected current stroke, frequency and stroke control signals may be generated.

The reference operating frequency determiner 140 may determine a reference operating frequency command value for varying the operating frequency, according to the frequency control signal. Similarly, the stroke determiner 161 may determine a stroke command value for varying the stroke, according to the stroke control signal.

The actual operating frequency determiner may 150 may receive the reference operating frequency command value, and determine an actual operating frequency command value based on a random value received from the random number generator 160. As described above, the actual operating frequency command value may be determined as the arbitrary value included within a range having a predetermined width around the reference operating frequency value (see FIG. 4). For example, during an arbitrary time in which the reference operating frequency command value acting as the first operating frequency is about 58 Hz, each of −0.3, −0.2, −0.1, 0, 0.1, 0.2, and 0.3 may be received from the random number generator 160, so that frequencies of about 57.7 Hz, 57.8 Hz, 57.9 Hz, 58 Hz, 58.1 Hz, 58.2 Hz, and 58.3 Hz may be continuously changed at a predetermined time interval, for example, at a time interval of about 0.1 seconds, and output. An order of the actual operating frequency command values as the second operating frequencies may not necessarily show a change toward the upper right side, and the actual operating frequency command values may not be limited to being determined with a limit of one decimal place.

Cases in which the linear motor is operated at the reference operating frequency and at the actual operating frequency will be compared and described hereinafter.

Figure 4:
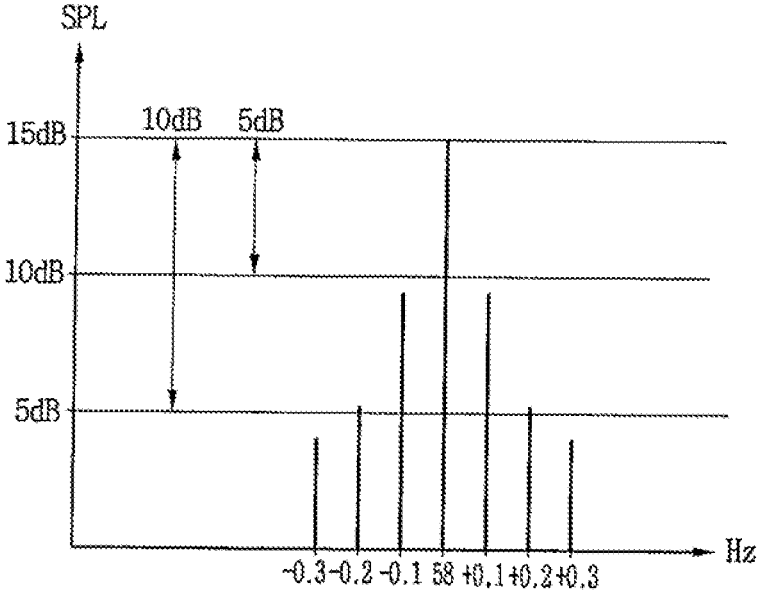
FIGS. 4 and 5 are graphs of frequency versus a sound pressure level (SPL) of a linear compressor, where
Figure 5:
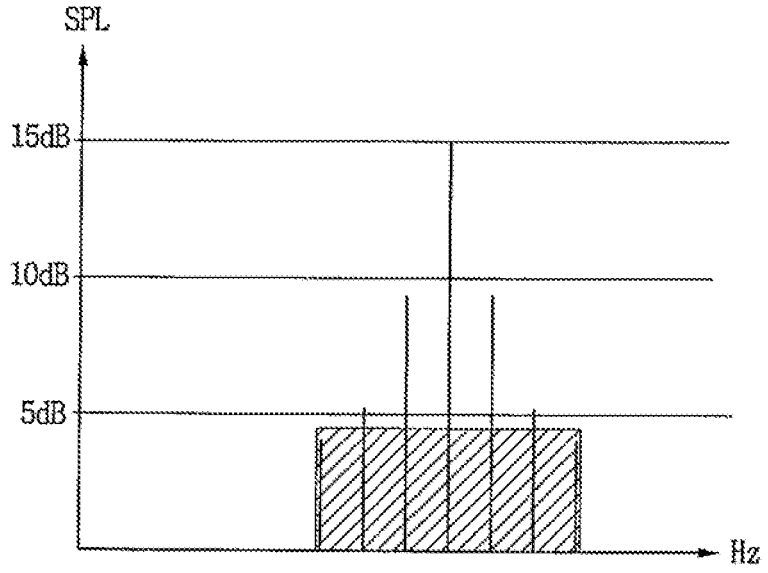

FIGS. 4 and 5 are graphs of frequency versus a sound pressure level (SPL) of a linear compressor. FIG. 4 illustrates a case in which a reference operating frequency is applied. FIG. 5 illustrates a case in which an actual operating frequency is applied. In the cases of FIGS. 4 and 5, it is assumed that a mechanism natural frequency (fm) is about 58 Hz.

Referring to FIG. 4, in a case in which the linear motor is operated at about 58 Hz during a predetermined time, a noise of about 15 dB occurs, and in a case, when differing from the mechanism natural frequency (fm) by 0.3 Hz at a periphery, a sound pressure level of the linear compressor may be rapidly reduced, for example, at about 57.7 Hz and about 58.3 Hz, noise may be reduced to about 5 dB or less. In the case in which the linear motor is operated at about 58 Hz using the reference operating frequency, which is the first operating frequency, noise of about 15 dB occurs. On the other hand, referring to FIG. 5, in a case in which frequencies of about 57.7 Hz, 57.8 Hz, 57.9 Hz, 58 Hz, 58.1 Hz, 58.2 Hz, and 58.3 Hz as the actual operating frequencies, which are the second operating frequencies, are operated with equal probability during the same time, it is shown that the linear compressor is operated with a noise that hardly causes inconvenience to a user even when it is slightly higher than about 5 dB (see cross-hatched box in FIG. 5).

Thus, when the linear motor is operated at the actual operating frequency, which is the second operating frequency, it is possible to actively and freely vary the operating frequency (fc) of the linear motor according to a load state of the linear compressor while excluding the influence of noise. As a result, it is possible to operate the linear compressor in a state in which the operating frequency (fc) of the linear motor and the natural frequency (fn) of the piston coincide with each other. In this case, the operating frequency (fc) of the linear motor may be freely operated with optimal efficiency. Meanwhile, in Equation 2, the range of the value of 'a' may be determined based on the fact that the value of 'a' is included within the phase difference between the current and the stroke, where the operating efficiency of the linear motor reaches nearly 100% as shown in FIG. 3. The range of the value of 'a' may be changed depending on a specific model of the linear motor, but it is shown that the optimal actual operating frequency may be obtained when the range of the value of 'a' is included within a range of about 0.3 Hz.

Referring again to FIG. 1, the comparator 170 may compare the actual operating frequency command value and the current operating frequency, and output a frequency correction signal based on the comparison result. In addition, the comparator 170 may compare the stroke command value and the current stroke, and output a stroke correction signal based on the comparison result.

The PWM controller 180 may output a PWM control signal for varying the operating frequency and the stroke according to the frequency correction signal and the stroke correction signal. The PWM control signal may include a PWM duty ratio variable signal and a PWM cycle variable signal. A stroke voltage may be varied by the PWM duty ratio variable signal, and the operating frequency may be varied by the PWM cycle variable signal.

The inverter 190 may vary a voltage and a frequency applied to the linear compressor 1, more specifically, the linear motor, according to the PWM control signal. More specifically, in the inverter 190, an ON/OFF time of an internal switching element may be controlled according to the RAN control signal, so that the frequency and voltage level of a DC voltage output from a power supply 75 may vary and be applied to the linear motor.

According to the apparatus for controlling the linear compressor, the actual operating frequency acting as the second operating frequency may be input to the linear motor as a command value. Thus, the natural frequency (fn) of the piston may be changed according to external conditions, and when the operating frequency (fc) varies in a range of about 56.5 Hz to 59 Hz, the operating frequency of the linear motor may vary as shown in FIG. 6.

Referring to FIG. 1, the operating frequency of the linear motor which is moved originally within a range of about 562 to 56.8 Hz may be changed to be moved within a range of about 58.7 to 59.3 Hz. In this instance, the operating frequency of the linear motor may be operated as the actual operating frequency, which is the second operating frequency, rather than the reference operating frequency, which is the first operating frequency. Thus, the operating frequency of the linear motor may be gradually continued toward the upper right side in the graph of FIG. 6 while fluctuating vertically.

In the case in which the linear motor is operated in this manner, even when there is the case in which the mechanism natural frequency (fm) and the actual operating frequency as the second operating frequency coincide with each other, a period of a coincidence time may be short, and the actual operating frequency may be immediately changed. Thus, a time of constructive interference absolutely required for causing a resonance effect is not satisfied, and therefore, a resonance phenomenon does not occur. In addition, the actual operating frequency may be immediately changed to cause destructive interference even when slight resonance currently occurs, and therefore, the resonance phenomenon cannot continue. Because of this, problems of noise and vibration cannot occur. In addition, the linear compressor may be operated with optimal operating efficiency by time average.

As described above, when the linear motor is operated according to the actual operating frequency as the first operating frequency, the operating frequency of the linear motor may be randomly and frequently changed for a short time. Thus, such an operating mode may be referred to as a random change mode.

The difference between the random change mode and the linear change mode may be clearly appreciated based on a comparison between the random change mode and the linear change mode in which the operating frequency of the linear motor is linearly changed when the linear motor is operated using the reference operating frequency as the second operating frequency. For reference, in FIG. 6, only the random change mode is performed. The linear change mode may be a mode in which the actual operating frequency determiner controls the actual operating frequency to be equal to the reference operating frequency. The random change mode may be performed even when the operating frequency of the linear motor is not changed in order to prevent the occurrence of the mechanical resonance phenomenon when the linear motor is operated. In other words, even when the reference operating frequency is not changed and maintained to be equal to the current frequency, it is possible to randomly vary the actual operating frequency using the random number generator. In this case, the linear motor may be controlled so as to prevent the occurrence of the mechanical resonance phenomenon in any case in which the linear compressor is operated.

Figure 2:
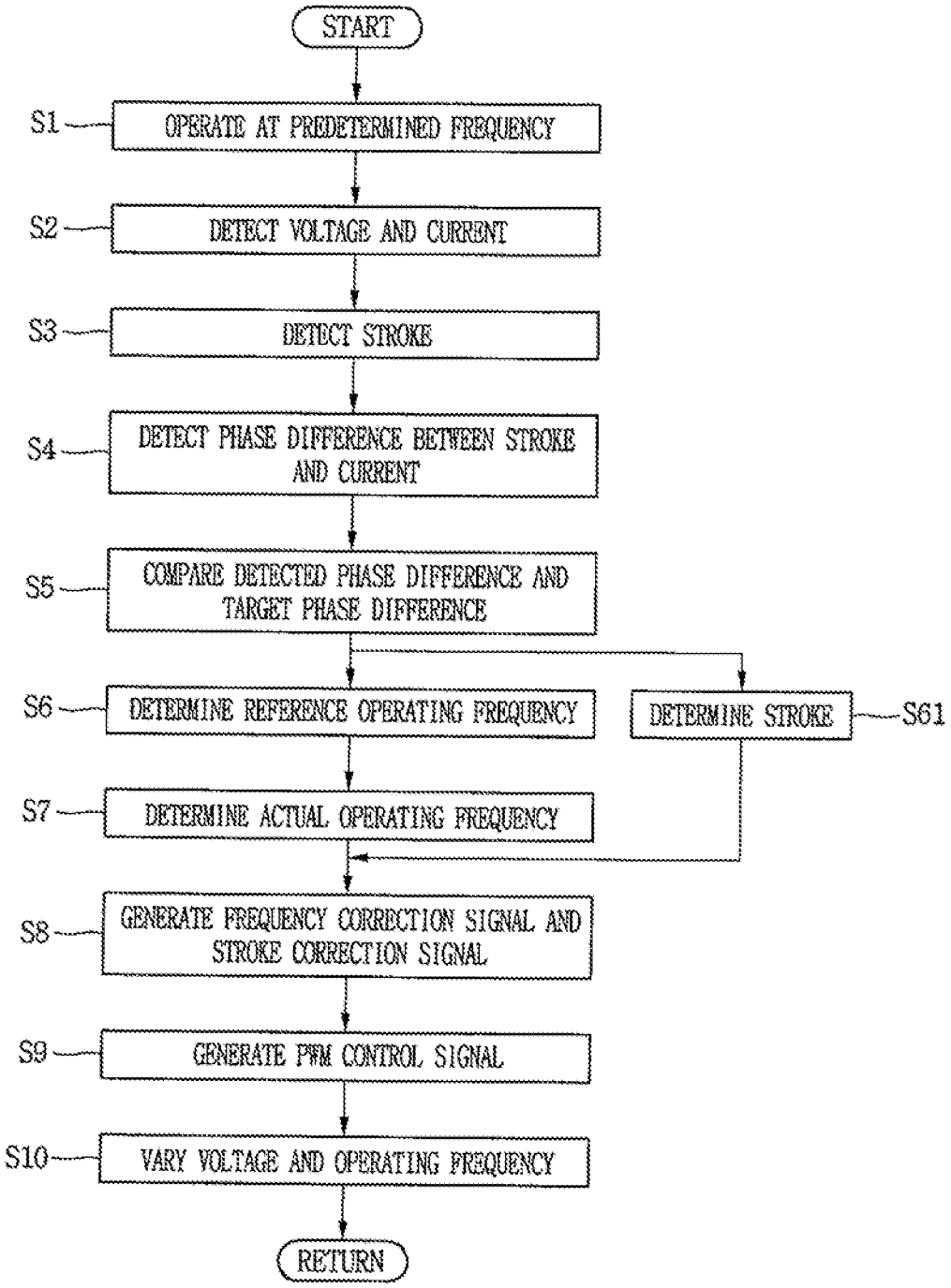
FIG. 2 is a flowchart of a method for controlling a linear compressor according to an embodiment.

FIG. 2 is a flowchart of a method for controlling a linear compressor according to an embodiment. Referring to FIG. 2, in step or operation S1, it is assumed that the linear compressor is operated at a predetermined operating frequency and stroke. In this state, in step or operation S2, the current detector 110 may detect a current of the linear motor, and the voltage detector 100 may detect a voltage of the linear motor.

In step or operation S3, the stroke detector 120 may detect a stroke using the detected current and voltage. The stroke detector 120 may detect the stroke using the detected current and voltage, and the control signal generator 130 may detect a phase difference between the detected stroke and current, in step or operation S4, and compare a phase difference between the detected current and the detected stroke and the target phase difference to output a control signal, in step or operation S5. The target phase difference may be an optimal value determined by experiment, set in advance as a fixed value according to a specification of the linear compressor, or given as a variable value.

The control signal generator 130 may determine that the current load of the linear motor is a high load when the phase difference between the detected current and the detected stroke is smaller than the target phase difference, and output a frequency control signal for changing the current operating frequency into a higher operating frequency. In an opposite case, the control may be performed in the opposite manner.

In step or operation S6, according to the frequency control signal, the reference operating frequency determiner 140 may determine an operating frequency higher than the current operating frequency as the first operating frequency and the reference operating frequency as a command value. In this instance, the reference operating frequency command value may be given as a predetermined value according to a magnitude of the load determined by experiment. In step or operation S7, after the reference operating frequency command value is determined, the actual operating frequency command value may be determined based on the reference operating frequency command value as a value obtained by adding or subtracting the random number. As described above, the actual operating frequency command value may be determined as an arbitrary value which is included in a predetermined range around the reference operating frequency command value and may be continuously changeable, using the random number generator 160. Meanwhile the predetermined range around the reference operating frequency may have a same range upward and downward centered around the reference operating frequency.

In step or operation S61, the stroke determiner 161 may determine a stroke command value for changing the current stroke into a higher stroke according to the stroke control signal. In step or operation S8, the comparator 170 may compare the actual operating frequency command value and the current operating frequency to output a frequency correction signal based on the comparison result, and compare the stroke command value and the current stroke to output a stroke correction signal based on the comparison result.

In step or operation S9, the PWM controller 180 may output a PWM control signal based on the frequency correction signal and the stroke correction signal. In step or operation S10, the inverter 190 may vary the stroke voltage and the operating frequency, which are applied to the motor, by the PWM control signal. An order of the respective steps or operations of the method for controlling a linear compressor according to embodiments may be changed within a required range.

According to the method for controlling the linear motor according to embodiments disclosed herein, as the actual operating frequency is the second operating frequency (f2), an arbitrary value (random value) included within the range within a predetermined width in the vertical direction around the reference operating frequency acting as the first operating frequency (f1) may be applied. Thus, the linear compressor may be operated without the influence of noise, and operated with optimal efficiency.

In addition, even when the reference operating frequency is not changed and maintained to be equal to the current frequency, as well as when the reference operating frequency is changed from the current operating frequency, it is possible to randomly vary the actual operating frequency using the random number generator. In this case, the mechanical resonance phenomenon does not occur at any time when the linear compressor is operated, and therefore, the linear motor may be controlled with optimal efficiency while preventing the influence of noise.

The apparatus and method for controlling a linear compressor according to this embodiment may be applied to a controller of the linear compressor in the form of hardware and software, and thereby may be applied directly to the linear compressor.

According to another embodiment, another usage will be proposed based on the previous embodiment. Thus, description of the previous embodiment may be directly applied to the description of this embodiment. In this embodiment, a noise measuring sensor may be further provided.

Figure 7:
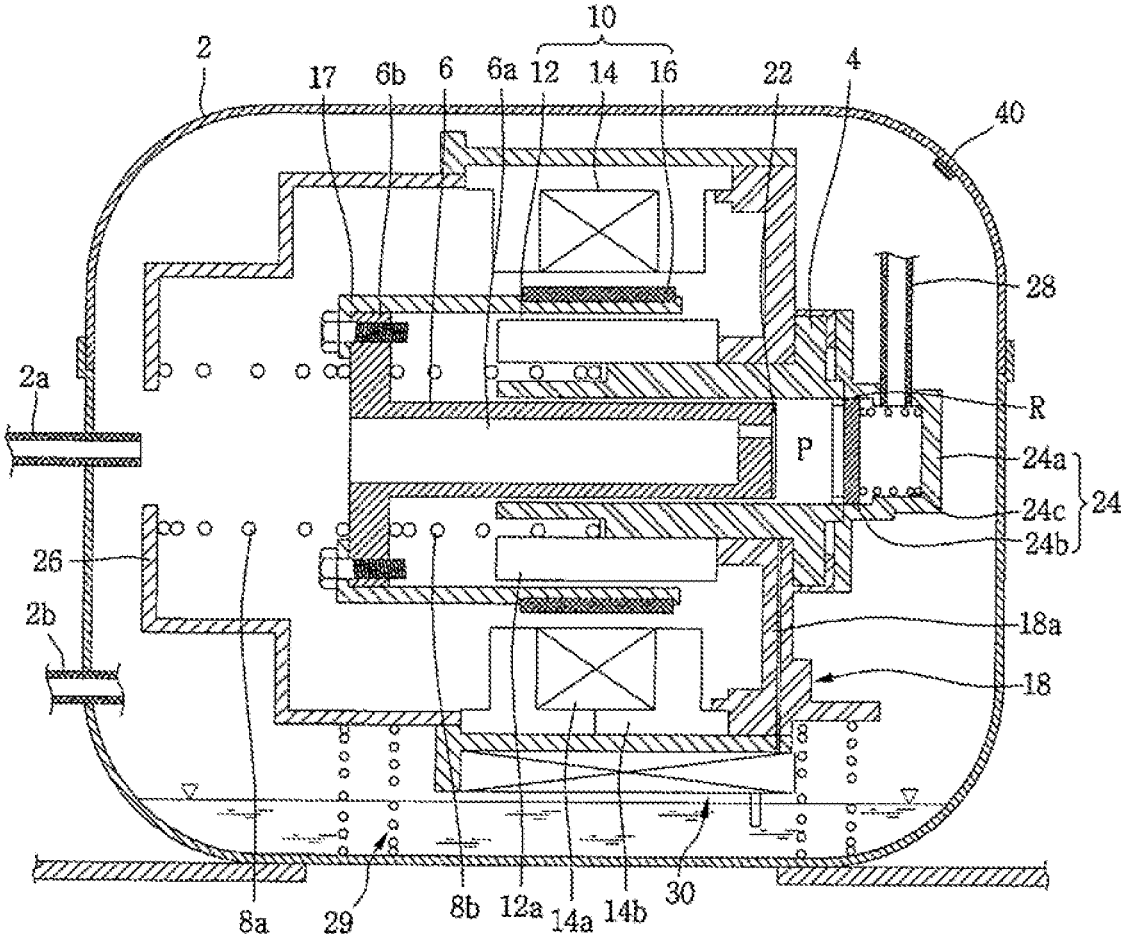
FIG. 7 is a cross-sectional view of a linear compressor according to another embodiment.

FIG. 7 is a cross-sectional view of a linear compressor according to another embodiment. Referring to FIG. 7, on one side of a sealed container 2, an inlet pipe 2*a* and an outlet pipe 2*b* for inflow/outflow of a refrigerant may be provided. A cylinder 4 may be fixedly provided to an inner side of the sealed container 2. The piston 6 may be provided inside of the cylinder 4 so as to linearly reciprocate, so that the refrigerant suctioned into a compression space P inside of the cylinder 4 may be compressed. A spring may be provided so that the piston 6 may be elastically supported in a moving direction of the piston 6. The piston 6 may be connected to a linear motor 10 that generates a linear reciprocating drive force.

A suction valve 22 may be provided at a first end of the piston 6 and in contact with the compression space P. A discharge valve assembly 24 may be provided at a first end of the cylinder 4 and in contact with the compression space P. Each of the suction valve 22 and the discharge valve assembly 24 may be automatically controlled so as to be opened and closed by a pressure inside of the compression space P.

An upper shell and a lower shell may be coupled to each other so that the inside of the sealed container 2 may be sealed. The inlet pipe 2*a* for inflow of the refrigerant and the outlet pipe 2*b* for outflow of the refrigerant may be respectively provided on or at one side of the sealed container 2. The linear motor 10 and the cylinder 4 may be assembled with each other by at least one frame 18 to form an assembly, and the assembly may be elastically supported by a support spring 29 on an inner bottom surface of the sealed container 2. A noise sensor 40 may be provided on an inner side of the sealed container 2. The noise sensor 40 may be provided in any specific location inside or outside of the sealed container 2 as long as it is safely mounted and ensures reliable noise measurement. A resulting measurement of the noise of the linear compressor detected by the noise sensor 40 may be transmitted to a controller of the linear compressor. For example, the resulting measurement of the noise detected by the noise sensor 40 may be transmitted to the actual operating frequency determiner 150 of FIG. 1.

A predetermined amount of oil may be stored on an internal bottom surface of the sealed container 2, and an oil supply device 30 to pump the oil may be provided in or at a lower end of the assembly. An oil supply pipe 18*a* to supply the oil between the piston 6 and the cylinder 4 may be formed inside of the frame 18. The oil supply device 30 may be operated by vibration generated according to a linear reciprocating movement of the piston 6 to pump the oil, and the pumped oil may be supplied to a gap between the piston 6 and the cylinder 4 through the oil supply pipe 18*a* to execute cooling/lubrication actions or functions. Other lubrication methods, such as an air lubrication method, may be used.

In the cylinder 4, the piston 6 may be provided so as to linearly reciprocate in the cylinder 4 in close proximity to the inlet pipe 2*a*, and the discharge valve assembly 24 may be provided at the first end of the cylinder 4 on aside opposite to the inlet pipe 2*a*. The discharge valve assembly 24 may include a discharge cover 24*a* provided to form a predetermined discharge space at the first end of the cylinder 4, a discharge valve 24*b* provided to open and close a first end of the compression space P of the cylinder 4, and a valve spring 24*c* as a type of coil spring that gives an elastic force in an axial direction between the discharge cover 24*a* and the discharge valve 24*b*. An O-ring R may be provided at an inner circumference of the first end of the cylinder 4, thereby bringing the discharge cover 24*a* into close contact with the first end of the cylinder 4. A loop pipe 28, which may be formed to be bent, may be connected between a first end of the discharge cover 24*a* and the outlet pipe 2*b*. The loop pipe 28 may guide the compressed refrigerant to be discharged outside of the sealed container 2, and buffer transmission, to all of the sealed container 2, of vibration caused by interaction among the cylinder 4, the piston 6, and the linear motor 10. According to the above-described configuration, when a pressure of the compression space P is equal to or higher than a predetermined discharge pressure as the piston 6 linearly reciprocates inside of the cylinder 4, the valve spring 24*c* may be compressed to open the discharge valve 24*b* and the refrigerant may be discharged from the compression space P. Next, the refrigerant may be discharged outside through the loop pipe 28 and the outlet pipe 2*b*.

In a center of the piston 6, a refrigerant passage 6*a* to allow the refrigerant flowing-in from the inlet pipe 2*a* to flow may be formed. The linear motor 10 may be directly connected to a second end of the piston 6 in close proximity to the inlet pipe 2*a* by a connection member 17, and the suction valve 22 may be provided in the first end of the piston 6 on a side opposite to the inlet pipe 2*a*. The suction valve 22 may be elastically supported by the spring in the moving direction of the piston 6. The suction valve 22 may have a thin plate shape, and a center portion of the suction valve 22 may be partially cut so as to open and close the refrigerant passage 6*a* of the piston 6. The suction valve 22 may be provided such that a first end of the suction value 22 may be fixed to the first end of the piston 6 by a screw, for example. According to the above-described configuration, when the pressure of the compression space P is less than a predetermined suction pressure lower than the discharge pressure as the piston 6 linearly reciprocates inside of the cylinder 4, the suction valve 22 may be opened so that the refrigerant may be suctioned into the compression space P. On the other hand, when the pressure of the compression space P is equal to or higher than the predetermined suction pressure, the refrigerant of the compression space P may be compressed in a state in which the suction valve 22 may be closed.

The piston 6 may be provided to be elastically supported in the moving direction of the piston 6. More specifically, a piston flange 6*b* that radially protrudes from the second end of the piston 6 in close proximity to the inlet pipe 2*a* may be elastically supported in the moving direction of the piston 6 by mechanical springs 8*a* and 8*b*, such as a coil spring. In addition, the refrigerant included in the compression space P on the side opposite to the inlet pipe 2*a* may serve as a gas spring by an elastic force of the refrigerant itself, and thereby elastically support the piston 6 through a predetermined gas spring constant (Kg). The mechanical springs 8*a* and 8*b* may be, respectively, provided side by side with a support frame 26 fixed to the linear motor 10 and with the cylinder 4 in an axial direction, with respect to the piston flange 6*b*. The mechanical spring 8*a* supported by the support frame 26 and the mechanical spring 8*b* provided in the cylinder 4 may be configured to have the same mechanical spring constant (Km).

The linear motor 10 may include an inner stator 2 including a plurality laminations 12*a* stacked in a circumferential direction and may be provided to be fixed to an outer side of the cylinder 4 by the frame 18, a coil winding body 14*a* around which a coil may be wound, an outer stator 14 including a plurality of laminations 14*b* stacked in the circumferential direction around the coil winding body 14*a*, and a permanent magnet 16 located in a gap between the inner stator 12 and the outer stator 14 and connected to the piston 6 by the connection member 17. In the above-described linear motor, as current is applied to the coil winding body 14*a*, an electromagnetic force may be generated, and the permanent magnet 16 may be linearly reciprocated by interaction between the electromagnetic force and the permanent magnet 16, so that the piston 6 connected to the permanent magnet 16 may be linearly reciprocated inside of the cylinder 4.

The linear compressor according to this embodiment may include the separate noise sensor 40 and the related configuration may be further applied, unlike the linear compressor according to the previous embodiment. Thus, when the noise sensor 40 and the related configuration are absent, the linear compressor of FIG. 7 may be applied to the previous embodiment.

Figure 8:
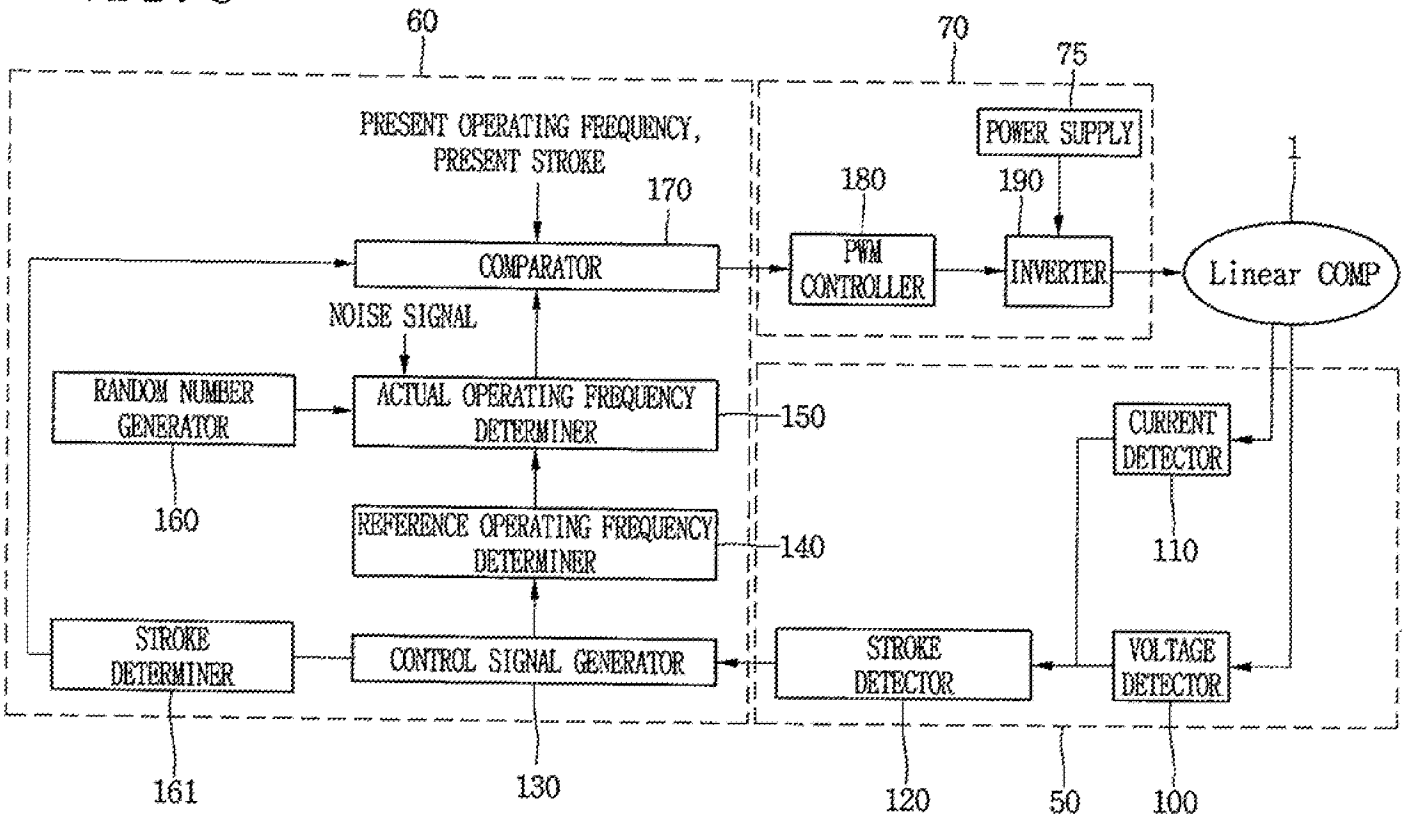
FIG. 8 is a block diagram of an apparatus for controlling a linear compressor according to another embodiment.

FIG. 8 is a block diagram of an apparatus for controlling a linear compressor according to another embodiment. Referring to FIG. 8, this embodiment may be the same or similar to the previous embodiments except for a difference therebetween in that a noise signal is input from the noise sensor 40 to the actual operating frequency determiner 150. The actual operating frequency determiner 150 may determine a degree of noise currently generated by the linear compressor, and may not perform a random change mode when a noise of a reference level is not generated. More specifically, for example, when a noise generated when the linear compressor is operated at the present time is about 5 dB or less, the current operating frequency (ft) of the linear motor may be significantly different from the mechanism natural frequency (fm). In this case, it is possible to perform the linear change mode without performing the random change mode. The reference operating frequency determined by the reference operating frequency determiner may be used as is, without changing the reference operating frequency.

In this case, it is possible to use the optimally proposed reference operating frequency as is, and therefore, the operating efficiency and energy use efficiency of the linear compressor may be maximized. When the noise becomes higher than a predetermined level, the actual operating frequency determiner 150 may perform the random change mode, thereby minimizing the influence of the noise.

Figure 9:
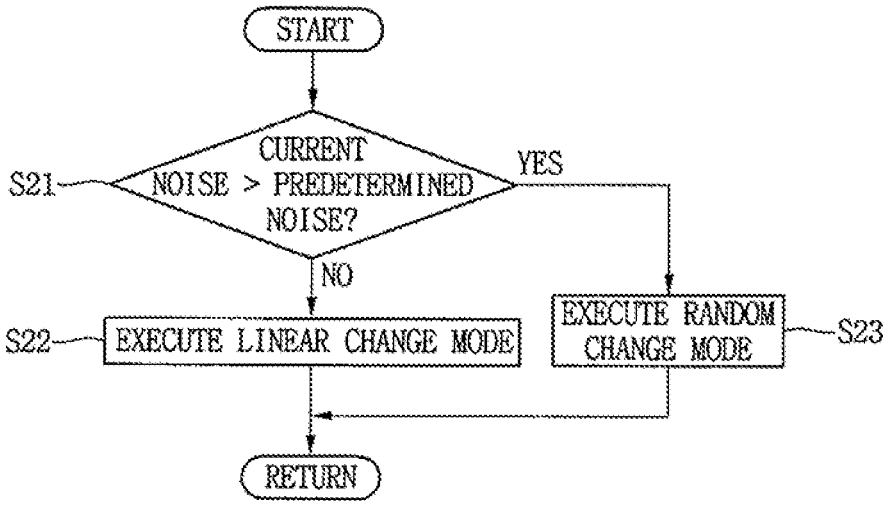
FIG. 9 is a flow chart of a method for controlling a linear compressor according to another embodiment.

FIG. 9 is a flowchart of a method for controlling a linear compressor according to another embodiment. Referring to FIG. 9, in step or operation S21, a current noise and a predetermined noise, which may be set in advance, may be compared. When the current noise is larger than the predetermined noise based on the comparison result, the random change mode may be executed, in step or operation S23, otherwise, the linear change mode may be executed, in step or operation 622.

According to the method for controlling the linear compressor according to embodiments disclosed herein, it is possible to suppress the occurrence of noise while maximizing the operating efficiency of the linear compressor. When the mechanism natural frequency (fm) according to the linear compressor is determined in advance, it may be unnecessary to separately measure noise. For example, when it is determined that the reference operating frequency given by the reference operating frequency determiner 140 overlaps or is adjacent to the natural frequency (fm), the actual operating frequency determiner 150 may be operated so that the random change mode may be performed even when there is no signal from the noise sensor 40.

According to still another embodiment, another usage will be proposed based on the descriptions of the previous embodiments. Thus, the descriptions of the previous embodiments may be applied to this embodiment, and repetitive description has been omitted.

Figure 10:
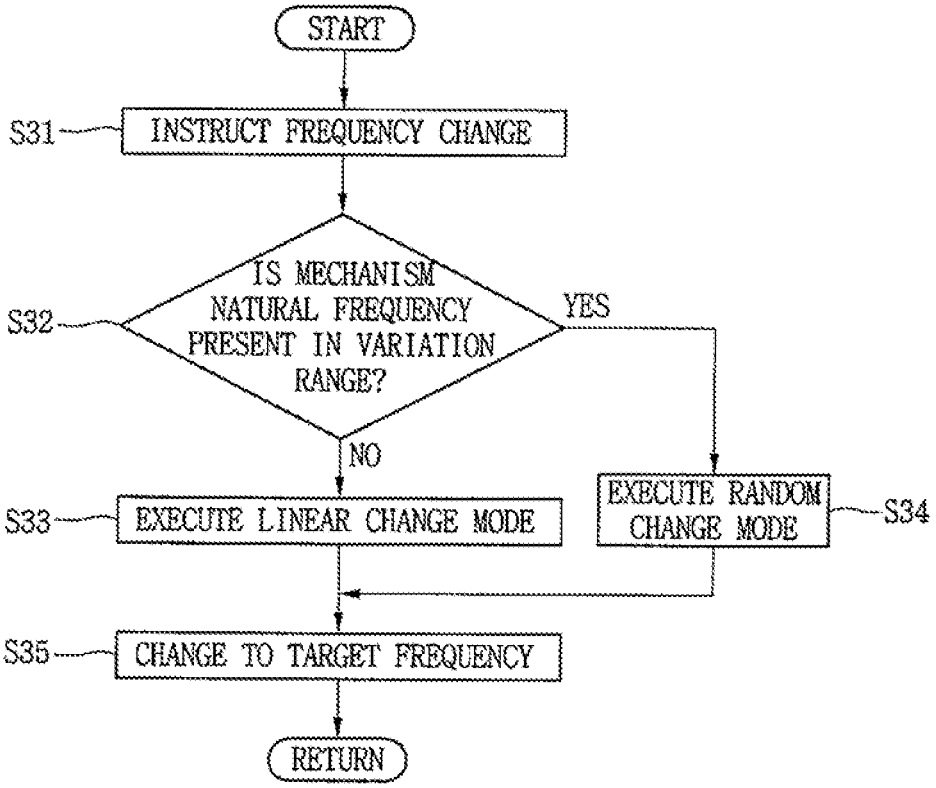
FIG. 10 is a flowchart of a method for controlling a linear compressor according to still another embodiment.

FIG. 10 is a flowchart of a method for controlling a linear compressor according to still another embodiment. Referring to FIG. 10, in step or operation S31, an instruction to change the operating frequency of the linear motor due to a factor, such as a load change, for example, may be generated. In step or operation S32, whether the mechanism natural frequency (fm) is present in variation ranges of a current operating frequency and the target operating frequency may be determined. When the mechanism natural frequency (fm) is present in the variation range based on the determination result, the random change mode may be executed, in step or operation S34, and when the mechanism natural frequency (fm) is absent from the variation range, the linear change mode may be executed during the variation range, in step or operation S33. Next, in step or operation S35, the change to the target frequency may be completed.

In this embodiment, when the mechanism natural frequency (fm) is known, it is possible to maximize the operating efficiency of the linear compressor while reducing the noise, by utilizing the mechanism natural frequency (fm).

Figure 11:
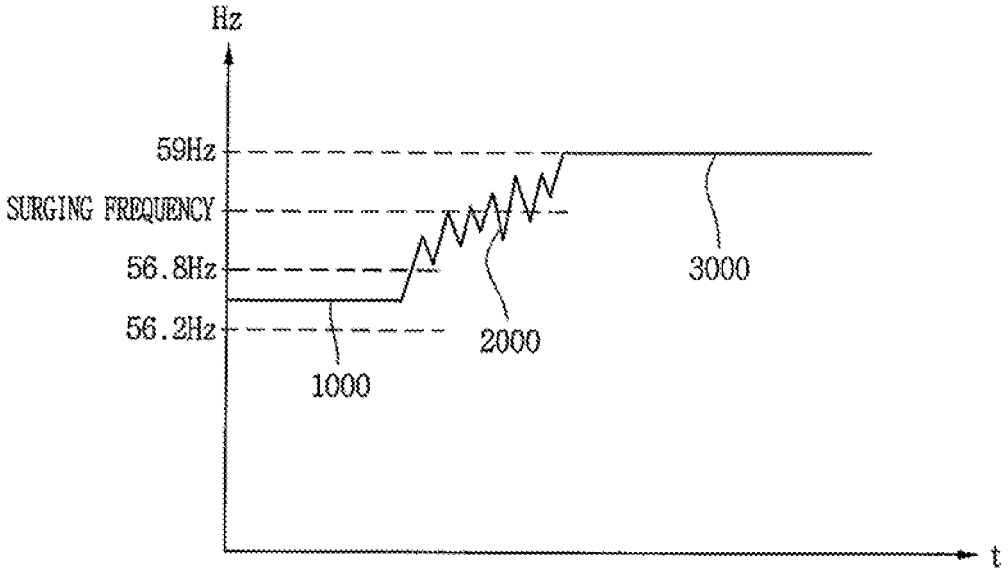
FIG. 11 is a graph illustrating variation of an operating frequency (fc) of a linear motor in a range of 56.5 Hz to 59 Hz according to the embodiment of FIG. 10.

FIG. 11 is a graph illustrating variation of an operating frequency (fc) of a linear motor in a range of 56.5 Hz to 59 Hz according to the embodiment of FIG. 10. Referring to FIG. 11, the natural frequency (fn) of the piston may be changed according to external conditions, so that an instruction to change the operating frequency (fc) of the linear motor from about 56 Hz to 59 Hz may be generated. However, it is determined that there is a surging frequency as the mechanism natural frequency (fm) at 58 Hz, and there is no mechanism natural frequency (fm) at other sections.

In the above-described case, the random change mode may be executed in a vicinity of about 58 Hz, and the linear change mode may be executed in the other sections. It may be confirmed that the linear change mode is executed in a section 1 (1000) and a section 3 (3000), and the random change mode may be executed in a section 2 (2000). The diagram according to FIG. 11 may be obtained even in the case of the previous embodiment.

According to embodiments, a mechanical resonance phenomenon in which noise is maximized may be suppressed, and therefore, it is possible to maximize an operating efficiency and energy consumption efficiency of the linear motor while reducing inconvenience to users caused by the occurrence of noise. Thus, the embodiments may be applied to the linear compressor of a premium level. In addition, only through improvement of software without separate additional facilities, the effects maybe achieved, and therefore, industrial application may be significantly expected.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An apparatus for controlling a linear compressor, comprising:

a detector that detects an operating state of the linear compressor, the operating state including at least a current of a linear motor and a voltage of the linear motor;

a controller that outputs a correction signal for correcting at least an operating frequency of the linear motor based on the operating state; and a drive signal generator that generates a drive signal of the linear motor according to the correction signal, the drive signal including a voltage and a frequency to be applied to the linear motor, and outputs the generated drive signal to the linear motor, wherein the controller includes:

a reference operating frequency determiner that determines a reference operating frequency at which the linear motor is operated according to the drive signal, the reference operating frequency being set as an operating frequency at which the operating frequency of the linear motor and a natural frequency of a piston in the linear compressor coincide with each other; and an actual operating frequency determiner that determines an actual operating frequency within a range of actual operating frequencies centered around the reference operating frequency, wherein the correction signal is determined based on the determined actual operating frequency, and wherein the actual operating frequency is continuously changed up and down based on the range of actual operating frequencies centered around the reference operating frequency while the reference operating frequency is maintained at a same frequency, to avoid a resonance phenomenon that occurs when the actual operating frequency coincides with a mechanism natural frequency of the linear motor.

2. The apparatus according to claim 1, wherein the detector includes:

a current detector that detects a current of the linear motor;

a voltage detector that detects a voltage of the linear motor; and a stroke detector that detects a stroke using the detected current and the detected voltage.

3. The apparatus according to claim 2, wherein the controller further includes:

a control signal generator that determines a current load of the linear motor according to a phase difference between the detected current and the detected stroke, and outputs to the reference operating frequency determiner a frequency control signal based on the determination result; and a comparator that compares the actual operating frequency and a current operating frequency, and outputs a frequency correction signal based on the comparison result.

4. The apparatus according to claim 3, wherein the control signal generator determines the current load of the linear motor according to the phase difference between the detected current and the detected stroke, and further outputs a stroke control signal based on a determination result, wherein the controller further includes a stroke determiner that determines a stroke command value for varying the stroke according to the stroke control signal, and wherein the comparator compares the stroke command value and the current stroke and outputs a stroke correction signal based on the comparison result.

5. The apparatus according to claim 1, wherein the drive signal generator includes:

a PWM controller that performs a PWM control based on the correction signal and outputs a PWM control signal; and an inverter that varies a voltage and a frequency to be output to the linear motor according to the PWM control signal.

6. The apparatus according to claim 1, wherein the controller further includes a random number generator that transmits a random number to the actual operating frequency determiner, so that the actual operating frequency is determined randomly.

7. The apparatus according to claim 1, wherein a noise signal generated in the linear compressor is transmitted to the controller, and the actual operating frequency determiner controls the actual operating frequency according to the noise signal.

8. The apparatus according to claim 7, wherein, when the noise signal has a value smaller than a predetermined noise value, the actual operating frequency is controlled to be equal to the reference operating frequency.

9. The apparatus according to claim 7, wherein the noise signal is transmitted to the actual operating frequency determiner.

10. The apparatus according to claim 1, wherein, when the reference operating frequency of the linear motor does not coincide with the mechanism natural frequency of the linear compressor, the actual operating frequency determiner controls the actual operating frequency to be equal to the reference operating frequency.

11. A linear compressor operated by the apparatus of claim 1.

12. The linear compressor according to claim 11, wherein a noise sensor is mounted in a sealed container of the linear compressor.

13. A method for controlling a linear compressor, the method comprising:

detecting an operating state of the linear compressor;

determining a reference operating frequency to output a correction signal for correcting at least an operating frequency of a linear motor based on the operating state, the reference operating frequency being set as an operating frequency at which the operating frequency of the linear motor and a natural frequency of a piston in the linear compressor coincide with each other;

determining an actual operating frequency within a range of actual operating frequencies centered around the reference operating frequency at which the linear motor is actually operated;

comparing the actual operating frequency and a current operating frequency and determining and outputting the correction signal; and generating a drive signal of the linear compressor according to the correction signal and outputting the generated drive signal to the linear compressor, wherein the actual operating frequency is continuously changed up and down based on the range of actual operating frequencies centered around the reference operating frequency while the reference operating frequency is maintained at a same frequency, to avoid a resonance phenomenon that occurs when the actual operating frequency coincides with a mechanism natural frequency of the linear motor.

14. The method according to claim 13, wherein the method includes a linear change mode in which the actual operating frequency is operated to be equal to the reference operating frequency, and a random change mode in which the actual operating frequency is continuously changed.

15. The method according to claim 14, wherein, when a current noise value of the linear compressor is greater than a predetermined noise value, the random change mode is performed.

16. The method according to claim 14, wherein, when the linear motor is operated at a frequency in close proximity to the mechanism natural frequency causing mechanical resonance of the linear compressor, the random change mode is performed.

17. An apparatus for controlling a linear compressor, the apparatus comprising:

means for detecting an operating state of the linear compressor, the operating state including at least a current of a linear motor and a voltage of the linear motor;

means for determining a reference operating frequency to output a correction signal for correcting at least an operating frequency of a linear motor based on the operating state, the drive signal including a voltage and a frequency to be applied to the linear motor the reference operating frequency being set as an operating frequency at which the operating frequency of the linear motor and a natural frequency of a piston in the linear compressor coincide with each other;

means for determining an actual operating frequency within a range of actual operating frequencies centered around the reference operating frequency, wherein the actual operating frequency is continuously changed up and down based on the range of actual operating frequencies centered around the reference operating frequency while the reference operating frequency is maintained at a same frequency, to avoid a resonance phenomenon that occurs when the actual operating frequency coincides with a mechanism natural frequency of the linear motor;

means for comparing the actual operating frequency and a current operating frequency and determining and outputting the correction signal; and means for generating a drive signal of the linear compressor according to the correction signal and outputting the generated drive signal to the linear compressor.

18. An apparatus for controlling a linear compressor, comprising:

a detector that detects an operating state of the linear compressor;

a controller that outputs a correction signal for correcting at least an operating frequency of a linear motor based on the operating state; and a drive signal generator that generates a drive signal of the linear motor according to the correction signal, and outputs the generated drive signal to the linear motor, wherein the controller determines a reference operating frequency at which the linear motor is operated, the reference operating frequency being set as an operating frequency at which the operating frequency of the linear motor and a natural frequency of a piston in the linear compressor coincide with each other, determines an actual operating frequency within a range of actual operating frequencies centered around the reference operating frequency, and determines the correction signal is determined based the actual operating frequency, and wherein the actual operating frequency is continuously changed up and down at a predetermined time interval based on the range of actual operating frequencies centered around the reference operating frequency while the reference operating frequency is maintained at a same frequency, to avoid a resonance phenomenon that occurs when the actual operating frequency coincides with a mechanism natural frequency of the linear motor.

* * * * *